US006293034B1

(12) United States Patent
Skapyak et al.

(10) Patent No.: US 6,293,034 B1
(45) Date of Patent: Sep. 25, 2001

(54) STEMWARE IDENTIFICATION BRACELETS AND METHOD OF USE

(76) Inventors: Kip M. Skapyak, 7448 Ridge Rd., Sarasota, FL (US) 34238; Ann DeLanghe, 3200 Poxpoint Rd., Burnsville, MN (US) 53337

( * ) Notice: Subject to any disclaimer, the term of this patent is extended or adjusted under 35 U.S.C. 154(b) by 0 days.

(21) Appl. No.: 09/755,490

(22) Filed: Jan. 4, 2001

Related U.S. Application Data

(60) Provisional application No. 60/174,410, filed on Jan. 5, 2000.

(51) Int. Cl.[7] ..... G09F 3/00
(52) U.S. Cl. ..... 40/310; 63/3
(58) Field of Search ..... 40/310, 324; 63/3; 70/456 R

(56) References Cited

U.S. PATENT DOCUMENTS

| | | | | |
|---|---|---|---|---|
| D. 47,490 | | 6/1915 | Hunter . | |
| D. 80,932 | | 4/1930 | Danco . | |
| D. 106,976 | | 11/1937 | Hokerk . | |
| D. 256,899 | | 9/1980 | Mazzini . | |
| D. 269,863 | | 7/1983 | Meyer . | |
| D. 406,213 | | 3/1999 | Rausch . | |
| D. 414,435 | | 9/1999 | Nahon . | |
| 605,584 | * | 6/1898 | Muffly | 70/456 R |
| 1,899,284 | * | 2/1933 | Manhard | 40/310 |
| 1,971,528 | | 8/1934 | Klebanow . | |
| 2,064,849 | * | 12/1936 | Pattillo | 40/310 |
| 2,250,666 | * | 7/1941 | Godefroy | 215/303 |
| 2,976,629 | | 3/1961 | Brixius et al. . | |
| 4,271,616 | * | 6/1981 | Boykin | 40/659 |
| 4,483,622 | * | 11/1984 | Muhi et al. | 366/129 |
| 4,680,882 | | 7/1987 | Watson, Jr. . | |
| 4,908,244 | | 3/1990 | Bullock . | |
| 4,951,596 | * | 8/1990 | Wallace, Jr. | 116/321 |
| 5,339,549 | * | 8/1994 | David et al. | 40/324 |
| 5,358,770 | * | 10/1994 | Evans | 428/99 |
| 6,086,702 | * | 7/2000 | Rea | 156/247 |

* cited by examiner

*Primary Examiner*—B. Dayoan
*Assistant Examiner*—Andrea Chop
(74) *Attorney, Agent, or Firm*—Gene Scott-Patent Law & Venture Group

(57) ABSTRACT

A wine bottle ring of a continuous unbroken form for accepting a neck of a wine bottle so the ring may be supported on the wine bottle. A plurality of wine glass rings, are formed of spring steel in a loop having a pair of opposing and abutting ends. The loops are of a size for accepting a stem of a wine glass, and further, for being supported on a base of a wine glass. The wine glass rings each provide a distinctive ornamentation so as to distinguish the wine glasses from each other. The method includes serving the wine bottle with the wine glass rings attached to the bottle ring so that the decorative elements are immediately visible. When the wine glasses are distributed to guests, each has one of the wine glass rings engaged on its stem so that one glass may be distinguished from the next.

5 Claims, 2 Drawing Sheets

STEMWARE IDENTIFICATION BRACELETS AND METHOD OF USE

The present invention claims the priority date of a prior filed provisional patent application having Ser. No. 60/174,410 and an official filing date of Jan. 5, 2000 and which discloses substantially the same material as described herein. The present invention is also described in a Document Disclosure Program document filed with the United States Patent And Trademark Office and having Ser. No. 466527.

BACKGROUND OF THE INVENTION

1. Field of the Invention

This invention relates generally to methods and means for marking items which may be otherwise indistinguishable in use and more particularly to a method and means for marking wine bottles and wine glasses.

2. Description of related Art

The following art defines the present state of this field:

Hunter, U.S. Pat. No. Des. 47,490 describes an article of manufacture.

Danco, U.S. Pat. No. Des. 80,932 describes a tag for containers.

Hokerk, U.S. Pat. No. Des. 106,976 describes a combined cake of soap and support therefor.

Mazzini, U.S. Pat. No. Des. 256,899 describes a decorative chain segment.

Meyer, U.S. Pat. No. Des. 269,863 describes a segmented heart-shaped pendant or similar article.

Rausch, U.S. Pat. No. Des. 406,213 describes a bottle collar.

Nahon, U.S. Pat. No. Des. 414,435 describes a bracelet thermometer for wine bottle.

Klebanow, U.S. Pat. No. 1,971,528 describes a display device for disposition upon the upper portion of a container comprising in combination a substantially flat sheet cut in the form of the form, a score line dividing the sheet into two leaves, and a flap eccentrically cut from one of the leaves, said flap being smaller in diameter than said leaves and adapted to bend on said score line.

Brixius et al., U.S. Pat. No. 2,976,629 describes an identifying device capable of being removably affixed to the neck of a bottle, comprising: a substantially planar circular plate adapted to receive identifying indicia thereon; engaging means adapted to engage the neck of said bottle to support said plate therefrom said engaging means being arcuate in configuration with an inside diameter mateable with the outside diameter of said plate, means for pivotally affixing said engaging means to said plate at a peripheral point thereon, said engaging means being pivotable form a first position substantially in the plane of said plate to a second position substantially transverse thereto, said affixing means defining a radially inwardly extending resilient leg juxtaposed to one surface of said plate and substantially parallel thereto.

Watson, Jr., U.S. Pat. No. 4,680,882 describes an identification tag for articles and containers, which is characterized by a base tag member having an extended leg for attachment to an article or looping through the handle of a container, the base tag member further provided with spaced indicia areas for identifying the article or the contents of the container and staggered snap openings extending through opposite faces of the base tag member for receiving at least a top cap member and preferably, a top cap member and a bottom cap member, each cap member having multiple snaps for engaging the snap openings and provided with a window which is aligned with selected ones of the indicia areas when the cap members are snapped on opposite faces of the base tag member.

Bullock, U.S. Pat. No. 4,908,244 describes an ornamental device and a kit therefor. In the preferred embodiment, layers of ornamental balls with progressively decreasing diameters are threaded down a shaft and nested together to simulate a Christmas tree. The kit may further include a protective support having pockets for receiving the various balls, base, shaft and decorative pinnacle for the device.

The prior art teaches the use of decorative devices for visual appeal, see Hunter, Danco, Hokerk, etc., and for function, see, for instance, Rausch, Nahon, and Klebanow. Such devices are generally used as identification means. However, the prior art does not teach the user of a bottle supported ring used as a carrier for wine glass supported decorative and identification rings such that one wine glass is clearly distinguishable from the next. The present invention fulfills these needs and provides further related advantages as described in the following summary.

SUMMARY OF THE INVENTION

The present invention teaches certain benefits in construction and use which give rise to the objectives described below.

A wine bottle ring of a continuous unbroken form provides an aperture of a size for accepting a neck of a wine bottle so the ring may be supported on the wine bottle. A plurality of wine glass rings, are formed of spring steel in a loop having a pair of opposing and abutting ends. The loops are of a size for accepting a stem of a wine glass forced through the abutting ends, and further, for being supported on a base of a wine glass when in use. The wine glass rings each provide a distinctive ornamentation so as to distinguish the wine glasses from each other. The method includes serving the wine bottle with the wine glass rings attached to the bottle ring so that the decorative elements are immediately visible. When the wine glasses are distributed to guests, each has one of the wine glass rings engaged on its stem so that one glass may be distinguished from the next.

A primary objective of the present invention is to provide an apparatus and method of use of such apparatus that provides advantages not taught by the prior art.

Another objective is to provide such an invention capable of easily distinguishing one wine glass from the next when in use.

A further objective is to provide a benefit in preventing the spread of disease.

A still further objective is to provide such an invention capable of providing an improved decorative or a theme appearance.

A yet further objective is to provide such an invention that is easy to use, and inexpensive to manufacture.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1A:
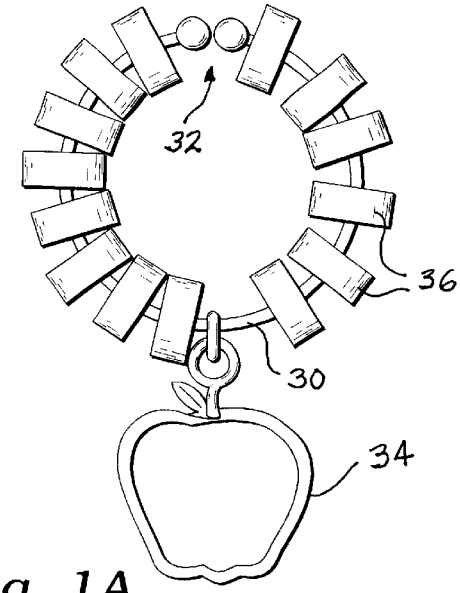
FIG. 1A is a plan view of a preferred embodiment of a wine glass ring of the invention.
Figure 1B:
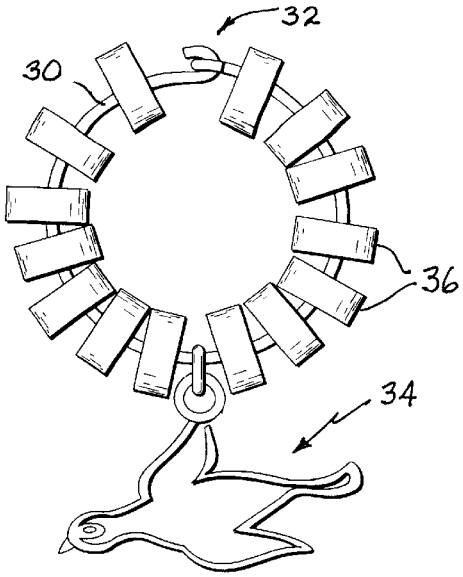
FIG. 1B is a plan view of another preferred embodiment of a wine glass ring thereof.
Figure 2:
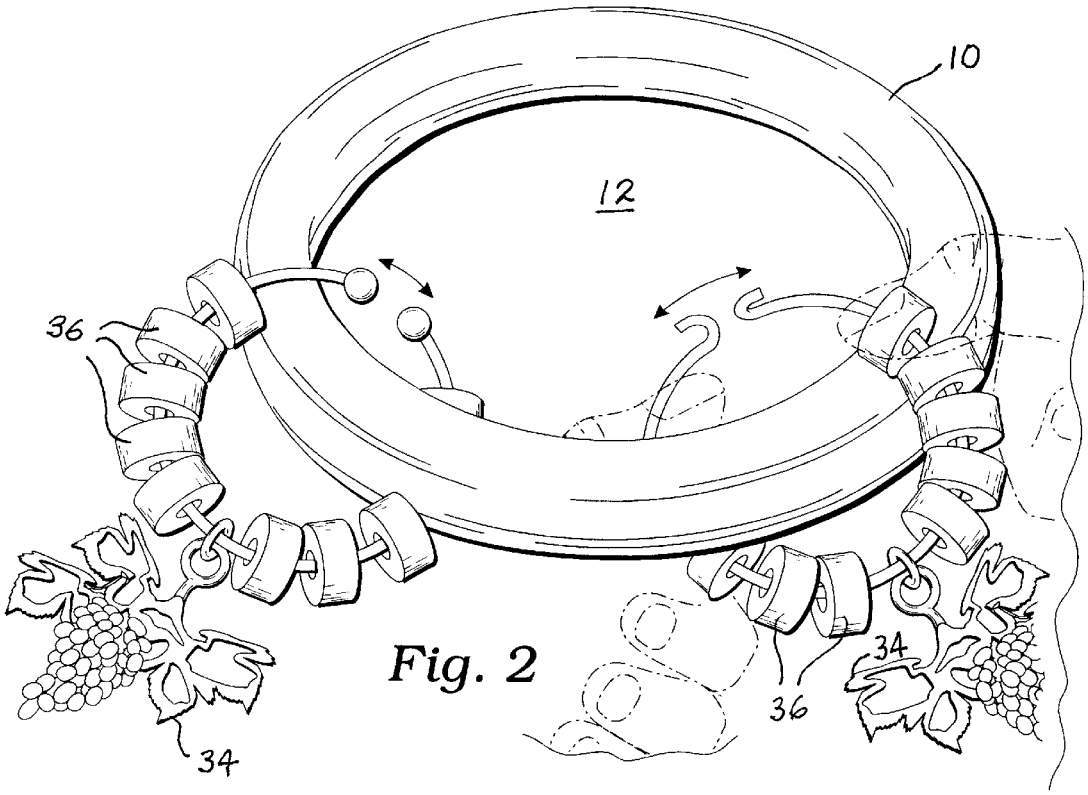
FIG. 2 is a perspective view of a bottle ring thereof, showing the manner of attachment of wine glass rings thereto.
Figure 3:
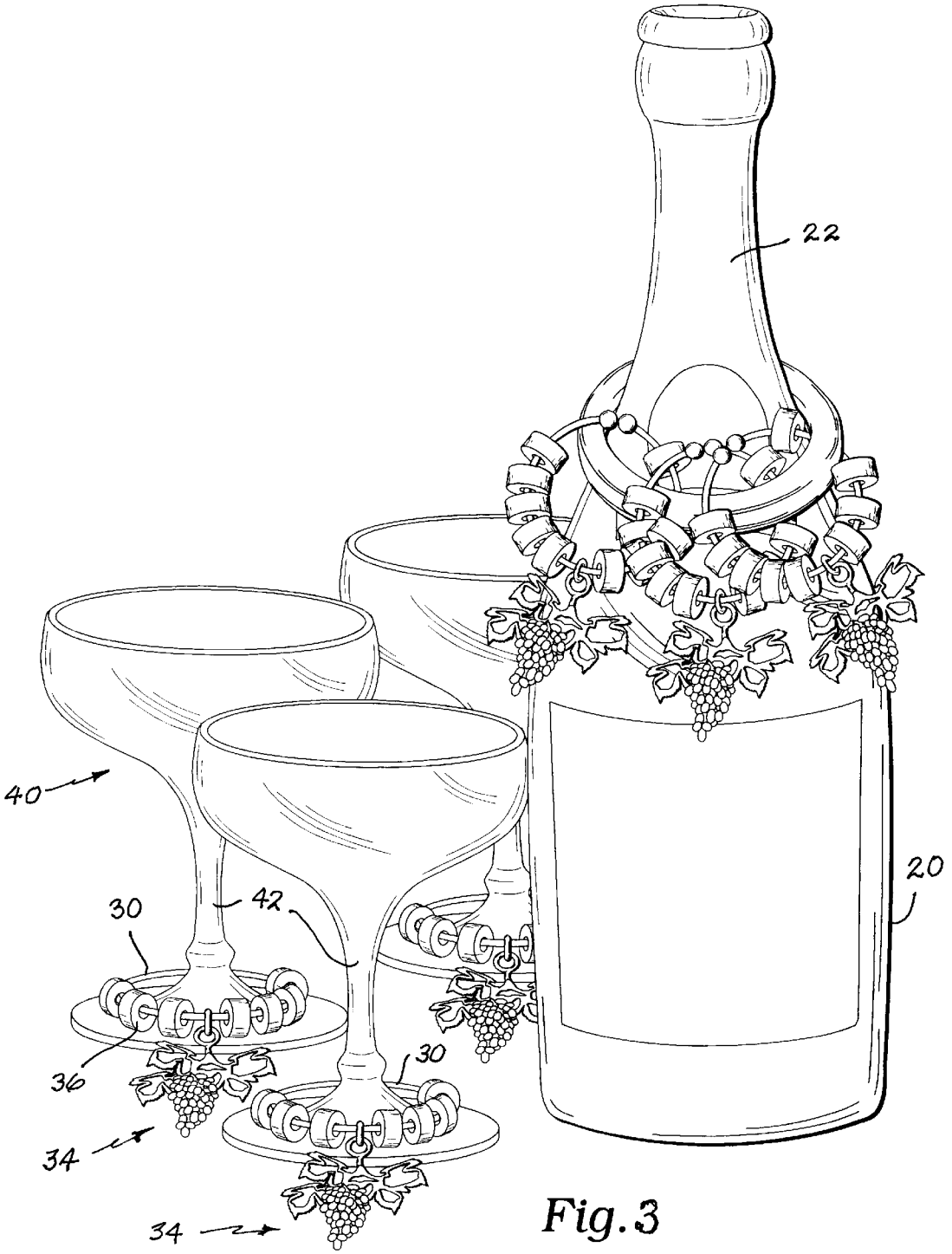
FIG. 3 is perspective view showing the manner of use of the invention.

In one embodiment the invention may be considered simply an identification apparatus comprising in combination, a wine bottle ring 10 of a continuous unbroken form, as shown in FIG. 3. The bottle ring 10 is preferably of a rigid and solid material such as metal or plastic and encloses a bottle ring aperture 12 of a size for accepting a neck 22 of a wine bottle 20 for supporting the wine bottle ring 10 on the wine bottle 20. The ring 10 may be round, as shown in the figures, or any similar shape such as oval, square, or polygonal. Its main feature is that it is rigid and able to be placed over the neck of a wine bottle while not being able to pass the wider portion of the wine bottle, so that it may be positioned as shown in FIG. 3. This is an important functional feature of the ring 10 and is necessary to accomplish one of the most important objective of the invention, that is, to mount the ring 10 for presentation with the wine bottle when the bottle is brought to the table. A plurality of wine glass rings 30 are each preferably formed of spring steel in a loop, as best seen in FIGS. 1A and 1B. These rings 30 each have a pair of opposing and abutting ends 32. The loops 30 are of a size for accepting a stem 42 of a wine glass 40, as shown in FIG. 3, and further, for being supported on a base 44 of the wine glass 40. The rings 30 are formed so as to assure that the ends 32 are in contact, as shown in FIG. 1A or locked together, as shown in FIG. 1B so that they cannot fall off the wine glasses 40, or the bottle ring 10, but may be engaged and disengaged at will as demonstrated in FIG. 2 (see arrows). The wine glass rings 30 each provide a distinctive means for ornamenting 34 so as to distinguish the wine glass rings 30 from each other, and therefore, in use, to also distinguish the wine glasses 40 from each other. Such distinguishment may be through shape, color, size or any other manner where it is possible to see that one of the rings 30 is clearly different from any one of the other rings 30. This is important as one may not be willing to inadvertently drink from another's glass in the prevention of the spread of disease. Clearly, in the midst of a party, it is not likely that the use of simple number stickers would be in keeping with the mood. On the contrary, it would seem be out of keeping with such events. However, when a decorative element is added to the wine glass, it enhances the party mood and may be selected to be in context with a party theme, such as numerical figures defining a birthday, i.e., 29+, statements such as "Over The Hill," and icons figures well known in defining occasions for graduation, birth, wedding, and son on.

The ornamenting means 34 is preferably such an icon as shown in FIG. 2, i.e., a bunch of grapes, but also may include at least one, but preferably a plurality of beads 36 which are preferably movable on the ring 30. This is important so that the ornamentation means 34 may be positioned or placed so as to be seen by the user. The opposing and abutting ends 32 of the loops of the wine glass rings 30 are preferably formed as mutually engagable hooks, as shown in FIG. 1B or as abutting spheres, as shown in FIG. 1A. In each case, the spring nature of the material of the ring 30 and of its preferred attitude keeps the ends 32 in abutment so as to assure that rings engagement on the glass stem 42 or on the ring 10.

Alternately, the present invention is comprised as described above in a combination. This combination comprises the wine bottle 20, a plurality of wine glasses 40 and the identification apparatus as described and shown in FIG. 3. The identification apparatus includes the wine bottle ring 10 and a plurality of the wine glass rings 30. Preferably, the wine glass rings 30 are themselves an assembly of the spring steel ring and the ornamentation means 34 along with beads 36 for positioning the ornamentation means 34 at a position for being viewed. It should be noticed that the beads 36 provide for easy adjustment of the ornamentation means 34.

The present invention further provides for a method of use wherein a user may distinguish one wine glass from another. This method provides the wine bottle ring 10 described above, of a continuous unbroken form enclosing a bottle ring aperture 12 of a size for accepting a neck 22 of the wine bottle 20 therein for supporting the wine bottle ring 10 on the wine bottle for presentation. Further, it provides for a plurality of wine glass rings 30 wherein each of the wine glass rings is visually distinguishable from each of the other wine glass rings 30. The method provides for placing the plurality of wine glass rings 30 on the bottle ring 10 and then placing the bottle ring 10 with the plurality of wine glass rings 30 over the neck of the wine bottle 20 for presentation. This is shown in FIG. 3. The method further calls for removing at least some of the wine glass rings 30 from the bottle ring 10 and placing each of the wine glass rings 30 around a stem 42 of one of the wine glasses 40 to distinguish the wine glasses 40 from each other in use.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination comprising: a wine bottle, a plurality of wine glasses and an identification apparatus, the identification apparatus including a wine bottle ring of a continuous unbroken form enclosing a bottle ring aperture of a size for accepting a neck of the wine bottle therein for supporting the wine bottle ring on the wine bottle; and a plurality of wine glass rings, each of the wine glass rings formed of spring steel in a loop having a pair of opposing and abutting ends, the loop of a size for accepting a stem of any one of the wine glasses, and further, for being supported on a base of any one of the wine glasses, the wine glass rings each providing a distinctive means for ornamenting so as to distinguish the wine glass rings from each other.

2. The combination of claim 1 wherein the ornamenting means on at least one of the wine glass rings includes at least one bead, the at least one bead movably engaged on the at least one of the wine glass rings.

3. The combination of claim 1 wherein the opposing and abutting ends of the loops of the wine glass rings are formed as mutually engagable hooks.

4. The combination of claim 1 wherein the opposing and abutting ends of the loops of the wine glass rings are formed as spheres.

5. A method of distinguishing one wine glass from another comprising: providing a wine bottle ring of a continuous unbroken form enclosing a bottle ring aperture of a size for accepting a neck of the wine bottle therein for supporting the wine bottle ring on the wine bottle; providing a plurality of wine glass rings wherein each of the wine glass rings is visually distinguishable from each of the other wine glass rings; placing the plurality of wine glass rings on the bottle ring; placing the bottle ring with the plurality of wine glass rings over the neck of the wine bottle for presentation; removing the wine glass rings from the bottle ring; placing each of the wine glass rings around a stem of one of a plurality of wine glasses to distinguish the wine glasses from each other.

* * * * *